US011491061B2

(12) United States Patent
Tomita

(10) Patent No.: US 11,491,061 B2
(45) Date of Patent: Nov. 8, 2022

(54) TRANSFER DEVICE

(71) Applicant: Koubou Ryo, Inc., Kagoshima (JP)

(72) Inventor: Ryoichi Tomita, Kagoshima (JP)

(73) Assignee: KOUBOU RYO, INC., Kagoshima (JP)

( * ) Notice: Subject to any disclaimer, the term of this patent is extended or adjusted under 35 U.S.C. 154(b) by 268 days.

(21) Appl. No.: 16/975,250

(22) PCT Filed: Nov. 2, 2019

(86) PCT No.: PCT/JP2019/043172
§ 371 (c)(1),
(2) Date: Aug. 24, 2020

(87) PCT Pub. No.: WO2020/137166
PCT Pub. Date: Jul. 2, 2020

(65) Prior Publication Data

US 2020/0405553 A1 Dec. 31, 2020

(30) Foreign Application Priority Data

Dec. 29, 2018 (JP) ..... JP2018-248807

(51) Int. Cl.
*A61G 5/14* (2006.01)
*A61G 5/12* (2006.01)
*A61G 5/10* (2006.01)

(52) U.S. Cl.
CPC ..... *A61G 5/14* (2013.01); *A61G 5/1013* (2013.01); *A61G 5/1051* (2016.11); *A61G 5/125* (2016.11); *A61G 2200/38* (2013.01)

(58) Field of Classification Search
CPC ..... A61G 5/14; A61G 5/1013; A61G 5/1051; A61G 5/1037; A61G 5/125; A61G 5/127;
(Continued)

(56) References Cited

U.S. PATENT DOCUMENTS 6,308,981 B1 * 10/2001 Proehl ..... A61G 7/1017 280/647
8,375,484 B2 * 2/2013 Ota ..... A61G 7/1017 5/81.1 R
(Continued)

FOREIGN PATENT DOCUMENTS

CN 108542562 A * 9/2018 ..... A61F 5/00
CN 109152688 B * 11/2020 ..... A61G 5/14
(Continued)

OTHER PUBLICATIONS

Pct, International Search Report for the corresponding application No. PCT/JP2019/043172, dated Jan. 28, 2020, with English translation.

*Primary Examiner* — Steve Clemmons
(74) *Attorney, Agent, or Firm* — Lucas & Mercanti, LLP

(57) ABSTRACT

Provided is a transfer device capable of moving a care receiver who has difficulty in walking by himself/herself to a desired place in a comfortable posture. The transfer device is capable of moving a care receiver by a care giver. The transfer device includes: a front wheel and a rear wheel; a support body which supports an upper body of the care receiver; a leg guide portion which is brought into contact with lower leg front surfaces of the care receiver and is inclinable frontward from an approximately vertical state; and a foot placing portion on which soles of the care receiver are placed; a rear wheel advancing and retracting mechanism configured to move the rear wheel rearward in an interlocking manner with frontward inclining of the leg guide portion.

5 Claims, 6 Drawing Sheets

(58) Field of Classification Search
CPC .... A61G 5/128; A61G 7/1017; A61G 7/1046; A61G 7/1086; A61G 7/1096; A61G 7/1092; A61G 7/1019; A61G 2200/38; B62B 3/02; B62B 5/0414; B62B 5/0438; B62B 5/0457
See application file for complete search history.

(56) References Cited

U.S. PATENT DOCUMENTS

| | | | | |
|---|---|---|---|---|
| 8,832,874 | B2 * | 9/2014 | Alexander | A61G 7/1046 254/1 OR |
| 9,009,886 | B2 * | 4/2015 | Hjort | A61G 7/1019 5/83.1 |
| 9,295,597 | B2 * | 3/2016 | Hjort | A61G 7/1092 |
| 10,792,205 | B2 * | 10/2020 | Batrice | A61G 7/1096 |
| 11,202,730 | B2 * | 12/2021 | Lingegard | A61G 7/1046 |
| 11,213,442 | B2 * | 1/2022 | Afshani | A61H 3/04 |
| 2006/0272090 | A1 * | 12/2006 | Woodward | A61G 7/1046 5/81.1 R |
| 2012/0104711 | A1 * | 5/2012 | Alexander | A61G 7/1017 280/47.34 |
| 2015/0090308 | A1 * | 4/2015 | Bos | A61G 5/127 135/67 |
| 2015/0250321 | A1 * | 9/2015 | Perry | A47C 16/04 297/423.11 |
| 2020/0078245 | A1 * | 3/2020 | Rubin | A61G 7/1096 |

FOREIGN PATENT DOCUMENTS

| | | | | |
|---|---|---|---|---|
| DE | 102011006359 | A1 * | 10/2012 | A61G 5/04 |
| DE | 102018133234 | A1 * | 6/2020 | A61G 7/1019 |
| JP | 2005-328950 | A | 12/2005 | |
| JP | 2012-040211 | A | 3/2012 | |
| JP | 2016-059598 | A | 4/2016 | |

* cited by examiner

TRANSFER DEVICE

CROSS REFERENCE TO RELATED APPLICATION

This Application is a 371 of PCT/JP2019/043172 filed Nov. 2, 2019, which, in turn, claims priority of the Japanese patent application no. 2018-248807, filed Dec. 29 2018, the above applications are incorporated herein by reference.

BACKGROUND OF THE INVENTION

Field of the Invention

The present invention relates to a transfer device capable of moving a care receiver who has difficulty in walking by himself/herself to a desired place in a comfortable posture.

Description of the Related Art

Conventionally, among persons having illnesses or handicaps and aged persons, there are a large number of almost bed-ridden people who cannot move with his own wills to predetermined places for bathing or excretion (hereinafter referred to as "care receivers"). Such a care receiver is moved to a desired place with the help of a care giver. In such movement, the care giver makes the care receiver sit on an end portion of a bed or the like and, thereafter, the care giver moves the care receiver by carrying the care receiver or placing the care receiver on a wheelchair.

However, moving the care receiver by carrying the care receiver imposes a large burden on the care giver. Further, the care receiver is moved in an unstable state and hence, large physical and mental burdens are imposed on both the care receiver and the care giver.

Still further, in moving of a care receiver which requires the care receiver to get on and off a wheelchair, it is necessary for a care giver to carry the care receiver. In this case, also large physical and mental burdens are imposed on both the care receiver and the care giver.

Under such circumstances, for example, JP 2005-328950 A (patent literature 1) discloses a transfer device which includes: a cart; a support strut which is mounted on the cart in an inclined manner in a longitudinal direction of the cart; a seat portion plate which is mounted on the support strut which is inserted below buttocks of a care receiver in a seated posture by advancing the cart, and supports the buttocks of the care receiver by lifting the seat portion plate by inclining the support strut rearward; a chest contact pad which is mounted on the support strut, and supports a chest of the care receiver whose buttocks are supported by the seat portion plate; and armpit support portions which hold the seated posture of the care receiver by supporting armpits of the care receiver whose chest is supported by the chest contact pad.

SUMMARY OF THE INVENTION

Surely, the transfer device according to patent literature 1 is excellent from a viewpoint that, with the use of the transfer device, a care receiver in a seated posture is transferred to the transfer device relatively easily, and is moved to a desired place.

In the transfer device having such a configuration, in transferring the care receiver to the transfer device, the seat portion plate is inserted below the buttocks of the care receiver so that the care receiver takes a frontwardly inclined posture whereby the transfer device becomes stable, and the care receiver is transferred while being lifted up due to a lifting operation of the seat portion plate interlocked with inclination of the support strut. However, the care receiver is moved to a desired place while maintaining such a seated posture and hence, a head of the care receiver is always directed downward during the movement and hence, a large burden is imposed on the care receiver.

The present invention has been made in view of the above-mentioned circumstances, and it is an object of the present invention to provide a transfer device capable of moving a care receiver who has difficulty in walking by himself/herself to a desired place in a comfortable posture.

To achieve the above-mentioned object, the present invention provides a transfer device having the following configurations.

According to the invention in claim 1, a transfer device capable of moving a care receiver by a care giver, the transfer device includes: a front wheel and a rear wheel; a support body configured to support an upper body of the care receiver; a leg guide portion configured to be brought into contact with lower leg front surfaces of the care receiver and configured to be inclined frontward from an approximately vertical state; and a foot placing portion on which soles of the care receiver are placed; and a rear wheel advancing and retracting mechanism configured to move the rear wheel rearward in an interlocking manner with frontward inclining of the leg guide portion.

According to the invention in claim 2, in the transfer device described in claim 1, the support body is formed of a support strut portion erected upright and an upper body guide portion disposed on an upper end of the support strut portion, and the upper body guide portion includes a grip portion which the care receiver grips and a handle portion which the care giver grips for moving the transfer device.

According to the invention in claim 3, in the transfer device described in claim 2, the upper body guide portion includes: an arm placing portion formed approximately horizontally, the arm placing portion on which the care receiver places his/her elbows to front arms; a chest contact portion configured to be brought into contact with a chest of the care receiver and being inclined rearwardly downward, the chest contact portion being connected to a rear portion of the arm placing portion; and an elbow engaging portion which is formed on the chest contact portion as an integral part of the chest contact portion at the rear portion of the arm placing portion so as to make an upper end edge of the chest contact portion protrude upward with respect to a rear end portion of the arm placing portion.

According to the invention in claim 4, in the transfer device described in claim 2 or 3, the upper body guide portion is formed in an advancing and retracting manner longitudinally in an approximately horizontal direction.

According to the invention in claim 5, in the transfer device described in claim 1, the transfer device further includes a brake which stops a rotation of at least the front wheel.

According to the invention described in claim 1, the transfer device capable of moving a care receiver by a care giver, the transfer device includes: the front wheel and the rear wheel; the support body configured to support an upper body of the care receiver; the leg guide portion configured to be brought into contact with lower leg front surfaces of the care receiver and configured to be inclined frontward from the approximately vertical state; and the foot placing portion on which soles of the care receiver are placed; and the rear wheel advancing and retracting mechanism configured to move the rear wheel rearward in an interlocking manner with frontward inclining of the leg guide portion. With such a configuration, by merely transferring the care receiver to the transfer device, a distance between the front and rear wheels is expanded and hence, stability of the transfer device during movement is enhanced.

Further, in transferring the care receiver to the transfer device, by merely bringing lower leg front surfaces of the care receiver into contact with the leg guide portion thus allowing the care receiver to lean on the leg guide portion with his/her own weight, the lower legs of the care receiver are inclined frontwardly downward and hence, the care receiver can maintain a comfortable posture during movement.

Further, in taking the care receiver off the transfer device, it is possible to bring the lower legs of the care receiver into an approximately upright state by merely pushing the transfer device in a sitting direction and hence, the care receiver can be seated in an extremely natural and comfortable posture.

Further, it is unnecessary to frontwardly incline the upper body of the care receiver more than necessary and hence, the care receiver can maintain a more comfortable posture during movement.

According to the invention described in claim 2, the support body is formed of the support strut portion erected upright and the upper body guide portion disposed on the upper end of the support strut portion, and the upper body guide portion includes the grip portion which the care receiver grips and the handle portion which the care giver grips for moving the transfer device. With such a configuration, in transferring the care receiver to the transfer device and during movement of the transfer device, the care receiver can prevent himself/herself from falling from the transfer device by merely gripping the grip portion thus ensuring safety. Further, the care giver can safely operate the transfer device by merely gripping the handle portion.

According to the invention described in claim 3, the upper body guide portion includes: the arm placing portion formed approximately horizontally, the arm placing portion on which the care receiver places his/her elbows to front arms; the chest contact portion configured to be brought into contact with a chest of the care receiver and being inclined rearwardly downward, the chest contact portion being connected to the rear portion of the arm placing portion; and an elbow engaging portion which is formed on the chest contact portion as an integral part of the chest contact portion at the rear portion of the arm placing portion so as to make an upper end edge of the chest contact portion protrude upward with respect to a rear end portion of the arm placing portion. With such a configuration, in transferring the care receiver to the transfer device and during movement of the transfer device, the care receiver can make his/her elbows engage with the elbow engaging portion by merely placing his/her front arms on the arm placing portion and hence, the care receiver can stably lean on the transfer device with his/her upper body.

The front arms of the care receiver are placed on the substantially horizontal arm placing portion and hence, the upper body of the care receiver is not frontwardly inclined more than necessary and hence, the care receiver can maintain a comfortable posture during the movement of the transfer device.

According to the invention described in claim 4, the upper body guide portion is formed in an advancing and retracting manner longitudinally in an approximately horizontal direction. Accordingly, the center of gravity of the care receiver with respect to the transfer device is adjustable. Further, the posture of the care receiver with respect to the transfer device is adjustable. Still further, in making the care receiver sit on a predetermined place, by pushing the upper body guide portion rearward in a final step, it is possible to make a seating object such as the chair and buttocks of the care receiver approach each other smoothly in a comfortable posture.

According to the invention described in claim 5, the transfer device further includes the brake which stops the rotation of at least the front wheel and hence, safety of the transfer device can be enhanced.

DETAILED DESCRIPTION OF THE PREFERRED EMBODIMENT

A transfer device according to the invention is a transfer device capable of moving a care receiver by a care giver. The transfer device includes: a front wheel and a rear wheel; a support body configured to support an upper body of the care receiver; a leg guide portion configured to be brought into contact with lower leg front surfaces of the care receiver and configured to be inclined frontward from an approximately vertical state; and a foot placing portion on which soles of the care receiver are placed; and a rear wheel advancing and retracting mechanism configured to move the rear wheel rearward in an interlocking manner with frontward inclining of the leg guide portion. That is, the preset invention intends to provide the transfer device capable of moving a care receiver who has difficulty in walking by himself/herself to a desired place in a comfortable posture.

In the description made hereinafter, with respect to a longitudinal direction of the transfer device 1, a right side in FIG. 2, that is, a support body 6 side is set as a front side, and a left side, that is, a foot placing portion 22 side is set as a rear side.

Hereinafter, an embodiment of a transfer device 1 according to the present invention is described with reference to drawings. In the description made hereinafter, the structures and parts which are equal on left and right sides or structures and parts which are symmetrical on left and right sides are given same symbols in principle, and the structures and the parts on only one of left and right sides are described. The description of the structures and the parts on the other side is omitted when necessary.

Figure 1:
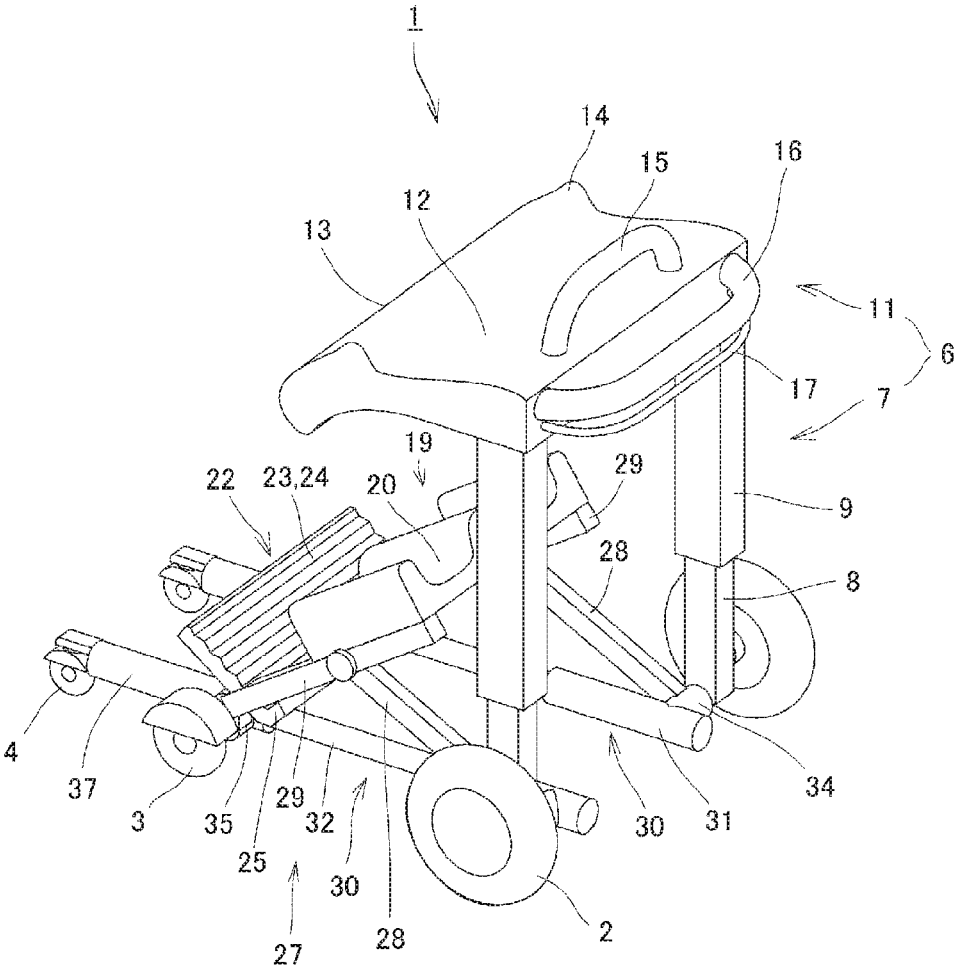
FIG. 1 is a perspective view of a transfer device according to an embodiment as viewed from an upper side.
Figure 5A:
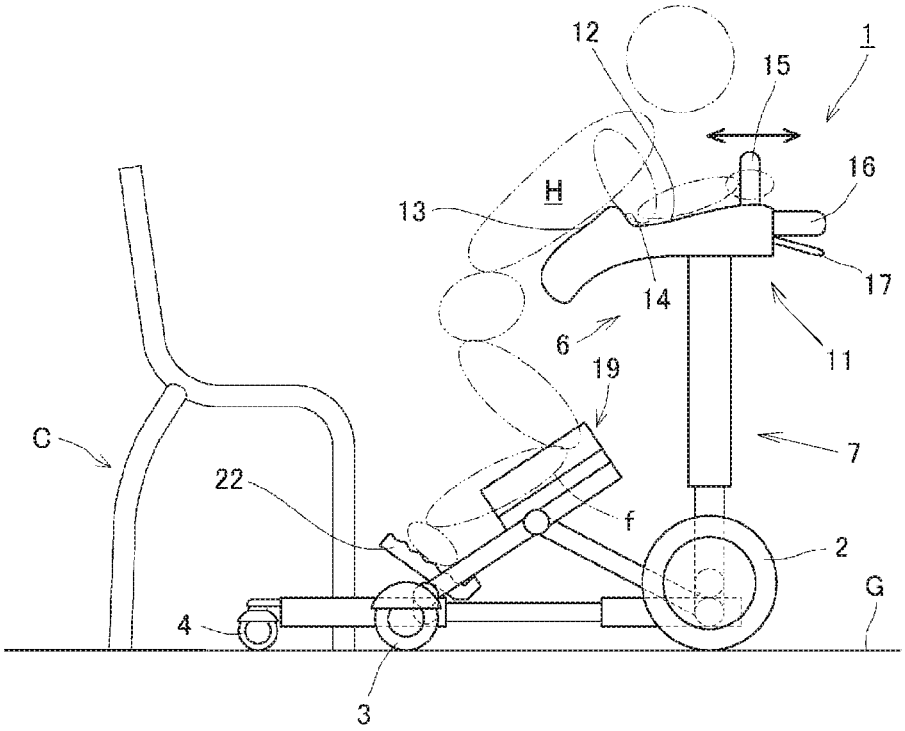
FIG. 5A is an explanatory view showing a mode immediately before and after the mode shown in FIG. 4B.

As shown in FIG. 1 and FIG. 5A, the transfer device 1 according to the embodiment of the present invention is capable of moving a care receiver H by a care giver. The transfer device 1 includes: front wheels 2 and rear wheels 3; a support body 6 which supports an upper body of the care receiver H; a leg guide portion 19 which is brought into contact with lower leg front surfaces f of the care receiver H and is inclinable frontward from an approximately vertical state; and a foot placing portion 22 on which soles of the care receiver H are placed; and a rear wheel advancing and retracting mechanism 27 configured to move the rear wheels 3 rearward in an interlocking manner with frontward inclining of the leg guide portion 19.

The support body 6 is formed of support strut portions 7 which are disposed upright and an upper body guide portion 11 which is disposed on upper ends of the support strut portions 7. The upper body guide portion 11 includes a grip portion 15 which the care receiver H grips, and a handle portion 16 which a care giver grips for moving the transfer device 1.

Further, the upper body guide portion 11 includes: an arm placing portion 12 which is formed approximately horizontally and on which the care receiver H places his/her elbows to front arms; a chest contact portion 13 which is brought into contact with a chest of the care receiver H, is inclined rearwardly downward, and is connected to a rear portion of the arm placing portion; and an elbow engaging portion 14 which is formed on the chest contact portion 13 as an integral part of the chest contact portion 13 at the rear portion of the arm placing portion 12 so as to make an upper end edge of the chest contact portion 13 protrude upward with respect to a rear end portion of the arm placing portion 12.

The upper body guide portion 11 is formed in an advancing and retracting manner longitudinally in an approximately horizontal direction.

Further, the transfer device 1 includes brakes which stop the rotation of at least front wheels 2.

With such a configuration, by merely transferring the care receiver H to the transfer device 1, a distance between the front and rear wheels 2, 3 is expanded and hence, stability of the transfer device 1 during movement can be enhanced. Further, in transferring the care receiver H to the transfer device 1, by merely bringing lower leg front surfaces f of the care receiver H into contact with the leg guide portion 19 thus allowing the care receiver H to lean on the leg guide portion 19 with his/her own weight, the lower legs of the care receiver H are inclined frontwardly downward and hence, the care receiver H can maintain a comfortable posture during movement.

Further, it is unnecessary to frontwardly incline the upper body of the care receiver H more than necessary and hence, the care receiver H can maintain a more comfortable posture during movement. Further, in taking the care receiver H off the transfer device 1, it is possible to bring the lower legs of the care receiver H into an approximately upright state by merely pushing the transfer device 1 in a sitting direction and hence, the care receiver H can be seated in an extremely natural and comfortable posture.

That is, the technique of the present invention can easily change the motion of the body in a comfortable posture by merely inclining or by approximately erecting upright the lower legs of the care receiver H by the transfer device 1.

Hereinafter, the constitutions of respective parts of the transfer device 1 according to this embodiment are specifically described in detail with reference to drawings.

Figure 2:
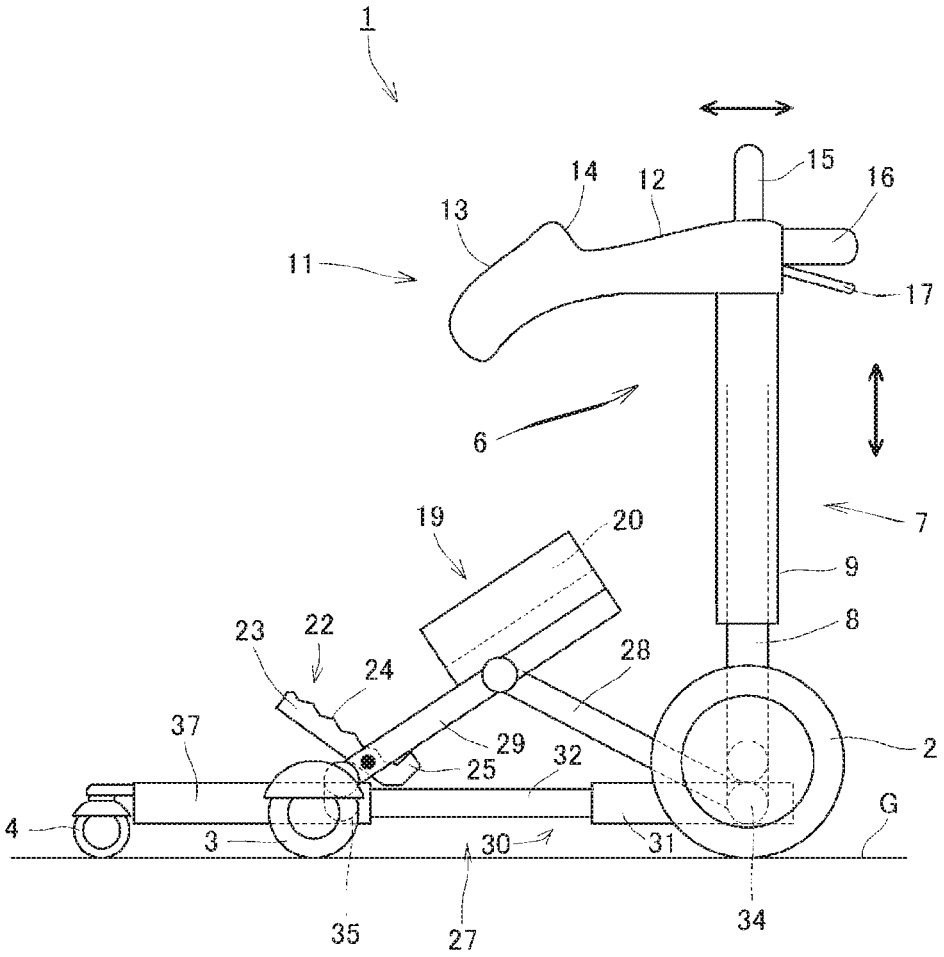
FIG. 2 is a side view of the transfer device according to the embodiment.

As shown in FIG. 1 and FIG. 2, the transfer device 1 includes two front wheels 2, two rear wheels 3 having a smaller diameter than the front wheels 2, and two auxiliary wheels 4 having a smaller diameter than the rear wheels 3. The front wheels 2 are rotatably and pivotally supported on outer sides of lower portions of the support strut portions 7 erected upright on left and right sides. The rear wheels 3 are rotatably and pivotally supported on outer sides of rear end edges of damper portions 30 which form a portion of the rear wheel advancing and retracting mechanism 27 described later by way of rear connecting portions 35. The auxiliary wheels 4 are rotatably and pivotally supported on lower sides of rear end portions of extension stays 37 extending rearward from rear ends of the damper portions 30.

There may be a case where the extension stays 37 and the auxiliary wheels 4 interfere with an object on which the care receiver H is seated depending on the object and hence, the transfer device 1 cannot be positioned at desired portions. Accordingly, the extension stays 37 and the auxiliary wheels 4 are not indispensable constitutional elements. However, in a case where the transfer device 1 becomes unstable because of positioning of the center of gravity of the transfer device 1 on a rear side in a state where the care receiver H rides on the transfer device 1, it is desirable to provide the extension stays 37 and the auxiliary wheels 4 to the transfer device 1. In this case, it is desirable that the extension stays 37 and the auxiliary wheels 4 are formed as low and small as possible.

It is desirable that a brake which stops the rotation is provided to the front wheels 2, the rear wheels 3 and the auxiliary wheels 4 respectively. The brake may have the structure which is provided to the respective wheels 2, 3 and 4 independently and manually operated. Alternatively, a wire type brake which is used in a general-use bicycle or the like may be provided together with a handle to a portion in the vicinity of the handle portion 16 described later which a care giver operates. Further, the brake may be a brake having any structure which can substantially fix the wheels.

The rear wheel advancing and retracting mechanism 27 is formed of: front inclined stays 28 and rear inclined stays 29 which are disposed on left and right sides of the transfer device 1 and are formed of an angular rod; and the damper portions 30. One end portions of the front inclined stays 28 are rotatably and pivotally connected to inner lower end edges of the support strut portions 7 by way of the front connecting portions 34, the rear inclined stays 29 are rotatably and pivotally connected to the outer sides of the rear end edges of the damper portions 30, and the other end portions of the front inclined stays 28 are rotatably and pivotally connected to intermediate portions of the rear inclined stays 29.

The damper portion 30 is formed of a cylinder 31 and a piston 32. That is, the damper portion 30 is a general-use biasing mechanism such as a shock absorber which is formed of an oil damper or a pneumatic damper which constantly generates a biasing force toward a contracting side. An outer side of a front end edge of the cylinder 31 is connected to an inner lower end edge of the support strut portion 7 by way of the front connecting portion 34, and the rear wheel 3 is disposed on an outer side of a rear end edge of the piston 32 by way of a rear connecting portion 35. The extension stays 37 provided with the auxiliary wheels 4 are connected to rear ends of the pistons 32.

The leg guide portion 19 extends between upper surfaces of upper half portions of the rear inclined stays 29 which are positioned parallel to each other in a lateral direction such that two rear inclined stays 29 are integrally joined to each other. In the same manner, the foot placing portion 22 is interposed between inner sides of lower end edges of the rear inclined stays 29 such that two rear inclined stays 29 are integrally joined to each other.

The leg guide portion 19 is formed in a W shape in cross section so as to allow lower legs of a human body to be approximately fitted in and guided by the leg guide portion 19. That is, two guide grooves 20 which are disposed parallel to each other in a lateral direction are formed in the leg guide portion 19 such that the guide grooves 20 extend in a longitudinal direction in a concave state.

In this embodiment, to reduce a load applied to the lower legs which are approximately fitted in and are brought into contact with the guide grooves 20, at least peripheries of the guide grooves 20 are formed of an elastic material such as urethane.

The foot placing portion 22 is fixed to inner side surfaces of the rear inclined stays 29 formed on left and right sides of the transfer device 1. The foot placing portion 22 is formed of a foot placing member 23 having an approximately flat shape and a restricting member 25 having a front side which is bent upward at an approximately right angle. A slip preventing portion 24 is formed on an upper surface of the foot placing member 23. The slip preventing portion 24 has a wave shape in side cross section which is formed of a plurality of concaves and convexes extending laterally and arranged in a longitudinal direction. The restricting member 25 is formed so as to prevent the removal of front portions of feet frontward from the foot placing portion 22.

As described above, in the rear wheel advancing and retracting mechanism 27, the leg guide portion 19 and the foot placing portion 22 are connected to each other. Accordingly, as indicated by a series of operations described in FIG. 3A to FIG. 4B, when the lower leg front surfaces f of the care receiver H incline and push the leg guide portion 19 frontward, the pistons 32 of the damper portions 30 extend in an interlocking manner with the frontward inclining of the rear inclined stays 29 so that the rear wheels 3 and the auxiliary wheels 4 which are connected with the pistons 32 can be moved rearward.

The number and the positions of the wheels, the structure of the rear wheel advancing and retracting mechanism 27 and the like are not limited to the above-mentioned embodiment.

The support body 6 is formed of: two support strut portions 7 erected upright parallel to each other in the lateral direction; and the upper body guide portion 11 which extends between the upper ends of the support strut portions 7. The support strut portion 7 is formed of a lower support strut 8 formed from an angular rod and an upper support strut 9 formed from an angular columnar pipe which encases the lower support strut 8 in a vertically slidable manner. The support body 6 also includes an engaging portion not shown in the drawing which can substantially fix the upper support strut 9 at a desired height with respect to the lower support strut 8.

For example, the engaging portion may be formed of: engaging lower holes which are formed in a side surface of the lower support strut 8 at a predetermined pitch vertically; engaging upper holes which are formed in a side surface of the upper support strut 9 at the same pitch as the engaging lower holes vertically; and an engaging pin which is inserted into both holes so as to fix the lower support strut 8 and the upper support strut 9 to each other. By adopting such an engaging pin, a length of the support strut portion 7 can be changed.

In this manner, by forming the support strut portion 7 of the support body 6 in a vertically adjustable manner, it is possible to adjust the transfer device 1 at a most suitable height corresponding to a physical structure of the care receiver H and hence, general-use property of the transfer device 1 can be enhanced.

The upper body guide portion 11 is formed of: the arm placing portion 12 which is formed approximately horizontally; the chest contact portion 13 which is gradually inclined rearwardly downward and is connected to an end portion of the arm placing portion; and an elbow engaging portion 14 which has a hook shape as viewed in a side view formed on the rear end portion of the arm placing portion 12 so as to make the upper end edge of the chest contact portion 13 protrude upward with respect to the rear end portion of the arm placing portion 12.

In this embodiment, to reduce a load applied to the front arms and the elbows which are placed on the arm placing portion 12 and the chest which is brought into contact with the chest contact portion 13, at least an upper half portion of the upper body guide portion 11, that is, a portion of the arm placing portion 12 and a portion of the chest contact portion 13 in the vicinity of surfaces of these parts are made of an elastic material such as urethane.

The grip portion 15 is formed at a center of an upper surface of a front portion of the arm placing portion 12. The grip portion 15 is formed such that both end portions of a round rod which extends laterally and is bent in an approximately downward U shape as viewed in a front view are connected to the arm placing portion 12 in an uprightly erected manner. The handle portion 16 is formed on an end surface of the front side of the arm placing portion 12. The handle portion 16 is formed such that both end portions of a round rod which extends laterally and is bent in an approximately U shape as viewed in a plan view are connected to the arm placing portion 12 in a protruding manner. With such a configuration, the care receiver H who is transferred to the transfer device 1 can easily grip the grip portion 15 in a state where the front arms are placed on the arm placing portion 12, and a care giver can easily move the transfer device 1 by pushing or pulling the transfer device 1 while gripping the handle portion 16.

The upper body guide portion 11 is formed in an advancing and retracting manner longitudinally in the approximately horizontal direction. For example, a slide portion such as a slide bearing may be formed between a lower side surface of the upper body guide portion 11 and an upper end surface of the support strut portion 7, an engaging hole may be formed in the lower side surface of the upper body guide portion 11, and an engaging portion which is vertically advanceable and retractable and is inserted into and fixed to the engaging hole may be formed on a portion of an upper peripheral side surface of the support strut portion 7 in a protruding manner. With such a configuration, the upper body guide portion 11 can be advanced or retracted longitudinally in the approximately horizontal direction, and the upper body guide portion 11 can be approximately fixed at a predetermined position.

An advancing and retracting restriction portion 17 which is formed approximately in the same shape as the handle portion 16 is formed on a lower portion of the handle portion 16. The advancing and retracting restriction portion 17 has a smaller diameter than the handle portion 16. The advancing and retracting restriction portion 17 is formed so as to be vertically movable using both end portions of the advancing and retracting restriction portion 17 as proximal ends.

The advancing and retracting restriction portion 17 is configured such that when the advancing and retracting restriction portion 17 is operated upward once, braking is applied so as to stop the rotation of the front wheels 2, and the advancing and retracting restriction portion 17 returns downward, and when the advancing and retracting restriction portion 17 is operated upward again, braking is released, and the advancing and retracting restriction portion 17 returns downward. With such a configuration, the care giver can easily operate the advancing and retracting restriction portion 17 while gripping the handle portion 16, and can maintain effective braking even when the care giver moves away from the transfer device 1.

That is, when braking is applied, even when a care giver grips only the handle portion 16 and pushes or pulls the transfer device 1, it is impossible to move the transfer device 1 since braking is applied to the front wheels 2. When the care giver grips the advancing and retracting restriction portion 17 together with the handle portion 16 so that the advancing and retracting restriction portion 17 moves upward, braking applied to the front wheels 2 is released and hence, the care giver can freely move the transfer device 1.

The transfer device 1 according to this embodiment is configured to be operated by operating the advancing and retracting restriction portion 17. However, the present invention is not limited to such a configuration.

The shape and the number of the support strut portions 7, the shape of the upper body guide portion 11, the positions, the number, the shape and the like of the grip portion 15, the handle portions 16 and the like are also not limited to the embodiment described above, and it is needless to say that the configuration where the respective parts of the transfer device 1 are electrically driven also falls within the scope of the gist of the present invention.

Figure 6:
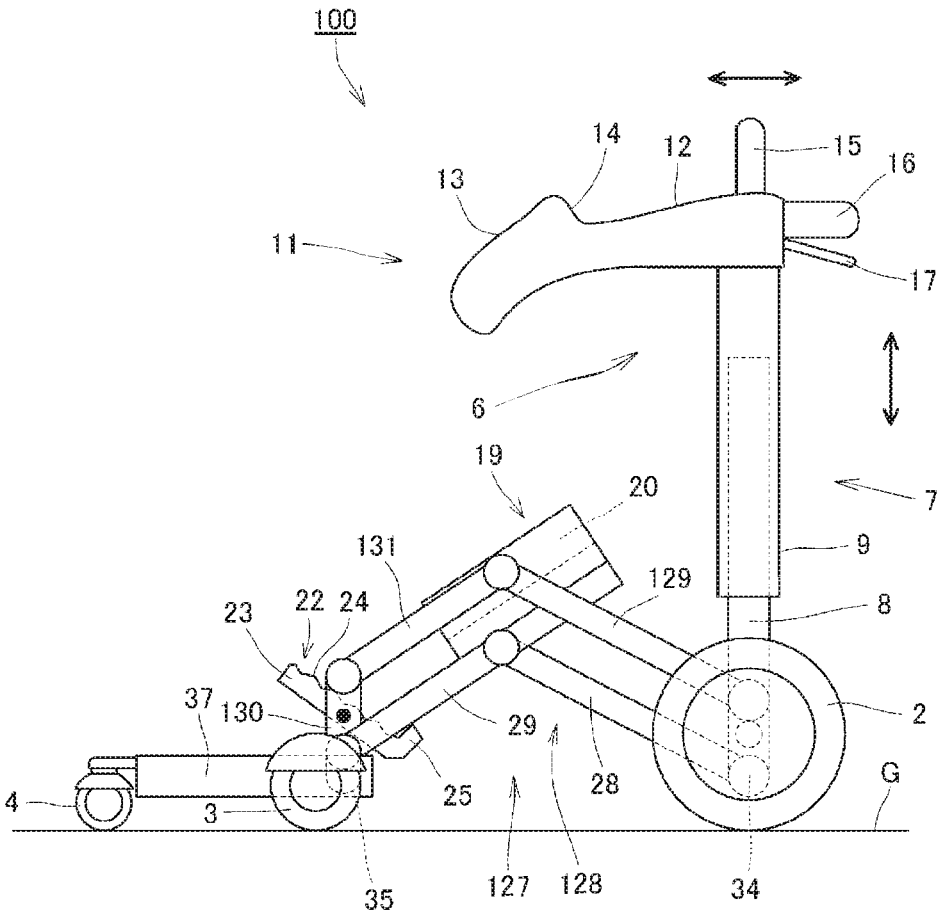
FIG. 6 is a side view showing a modification of the transfer device according to the embodiment.

A modification of the transfer device 1 which is a transfer device 100 provided with another example of the above-mentioned rear wheel advancing and retracting mechanism 27 is described with reference to FIG. 6.

The constitutions of respective parts which are used in the transfer device 1 and the transfer device 100 in common are given same symbols and the description of such parts is omitted when necessary.

The transfer device 100 according to the modification does not have the damper portion 30 descried above in a rear wheel advancing and retracting mechanism 127, but has a link mechanism 128 similar to the structures of both the front inclined stays 28 and the rear inclined stays 29 above these stays 28, 29.

More specifically, the link mechanism 128 further includes upper front inclined stays 129 which are formed from an angular rod, proximal end stays 130 and upper rear inclined stays 131 which are respectively disposed on left and right sides of the transfer device 100. One end portions of the upper front inclined stays 129 are rotatably and pivotally connected to inner lower end edges of support strut portions 7 above front connecting portions to which the front inclined stays 28 are pivotally connected. One end portions of the proximal end stays 130 are rotatably and pivotally connected to rear connecting portions 35 to which the rear inclined stays 29 are pivotally connected. Respective end portions of the upper rear inclined stays 131 are pivotally connected to the other end portions of the upper front inclined stays 129 and the other end portions of the proximal end stays 130.

The front inclined stays 28 and the upper front inclined stays 129 and the rear inclined stays 29 and the upper rear inclines stays 131 are formed substantially parallel to each other with a predetermined gap therebetween on both left and right sides of the transfer device 100. The gap is changed corresponding to the inclination of the proximal end stays 130.

A foot placing portion 22 is fixed to inner side surfaces of the proximal end stays 130 formed on left and right sides of the transfer device 100.

Also with the use of the rear wheel advancing and retracting mechanism 127 according to the modification having such a configuration, when lower legs of a care receiver H incline and push a leg guide portion 19 frontward, it is possible to move rear wheels 3 and auxiliary wheels 4 rearward in an interlocking manner with the frontward inclining of the rear inclined stays 29, the upper rear inclined stays 131 and the proximal end stays 130.

To apply a biasing force such that the front wheels 2 and the rear wheels 3 constantly come towards each other in a non-load state, a spring member may be disposed at respective pivotal connecting portions between the upper front inclined stays 129, the upper rear inclined stays 131 and the proximal end stays 130 so that an angle made by the upper front inclined stay 129 and the upper rear inclined stay 131 and having an apex at the pivotal connecting portion is formed in an upwardly projecting manner.

A spring member may be disposed also at respective pivotal connection portions between the front inclined stays 28 and the rear inclined stays 29.

As described above, with respect to the structure of the rear wheel advancing and retracting mechanism, provided that lower legs of the care receiver H incline and push a leg guide portion 19 frontward so that the rear wheels 3 and the auxiliary wheels 4 can be moved rearward, for example, various modifications and alternations are conceivable within the scope of the gist of the present invention such as forming the proximal end stay 130 and the upper rear inclined stay 131 of the modification described above using a single damper or the like.

Next, one example of the method of using the transfer devices 1, 100 according to the above-mentioned embodiments is briefly described.

In the description made hereinafter, the case is described where a brake of the locking mechanism which manually stops the rotation of the rear wheel is provided to each rear wheel 3 itself.

Figure 3A:
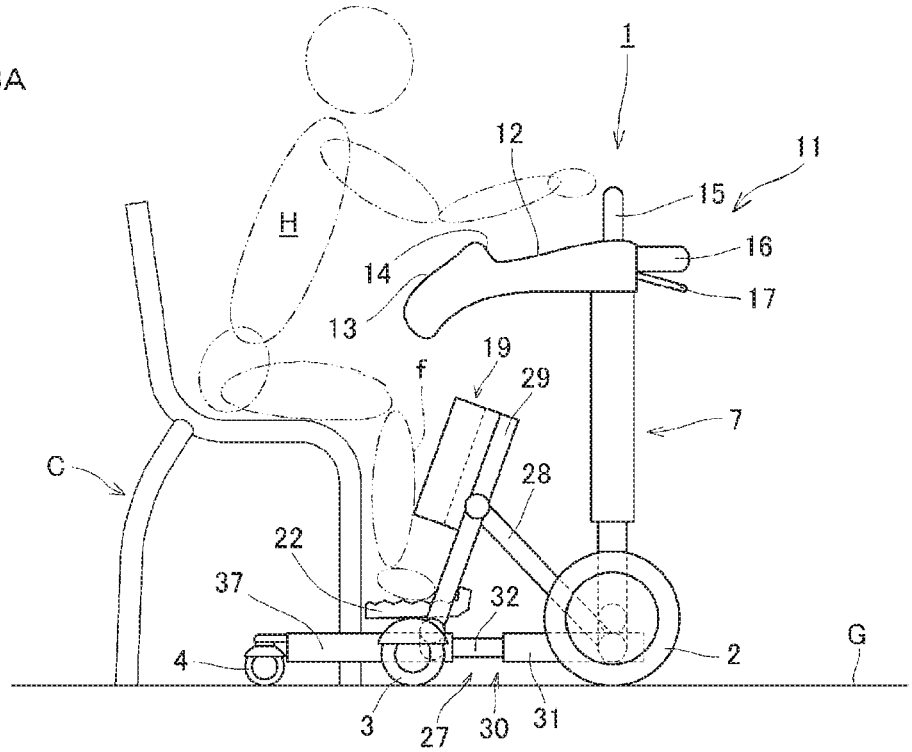
FIG. 3A is an explanatory view showing a mode where a care receiver gets on or off the transfer device according to the embodiment.

First, as shown in FIG. 3A, the transfer device 1 is moved to a position in front of a care receiver H being seated on a chair C. Then, braking is applied to the front wheels 2 by gripping the handle portion 16 and the advancing and retracting restriction portion 17. Then, braking is applied to the rear wheels 3 manually by the brakes of the locking mechanism.

Next, the care receiver H places both feet on the foot placing portion 22, and extends both arms and grips the grip portion 15.

Figure 3B:
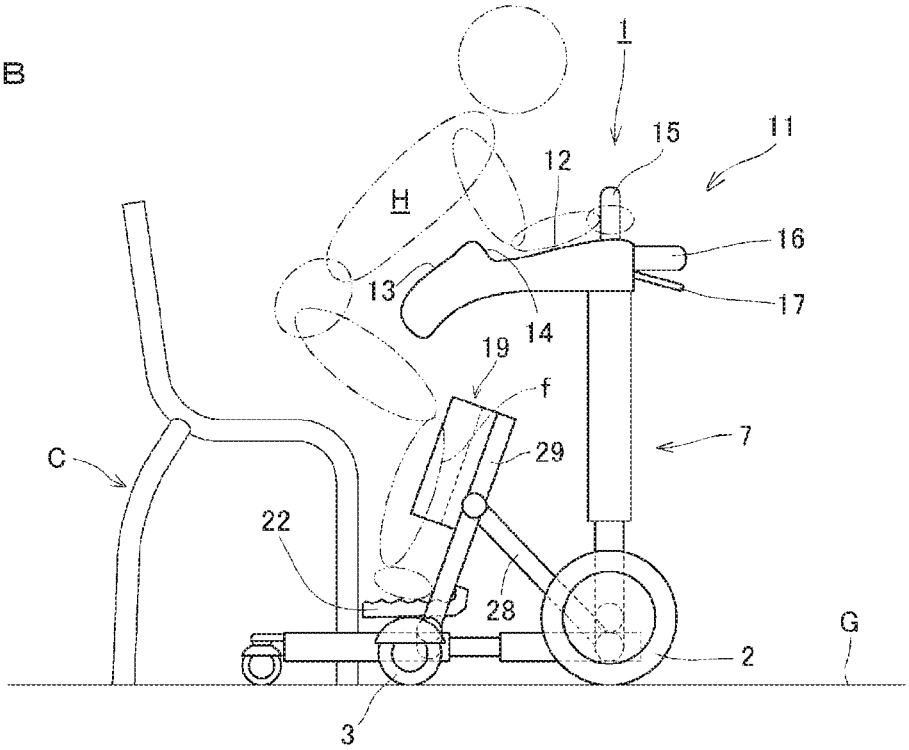
FIG. 3B is an explanatory view showing a mode immediately before and after the mode shown in FIG. 3A.

Then, as shown in FIG. 3B, the care receiver H holds the grip portion 15 and makes his/her body approach the transfer device 1 by the strength of his/her arms, places his/her front arms on the arm placing portion 12, and brings his/her lower leg front surfaces f into contact with the leg guide portion 19.

When the arm strength of the care receiver H is weak, a care giver helps the care receiver H.

Figure 4A:
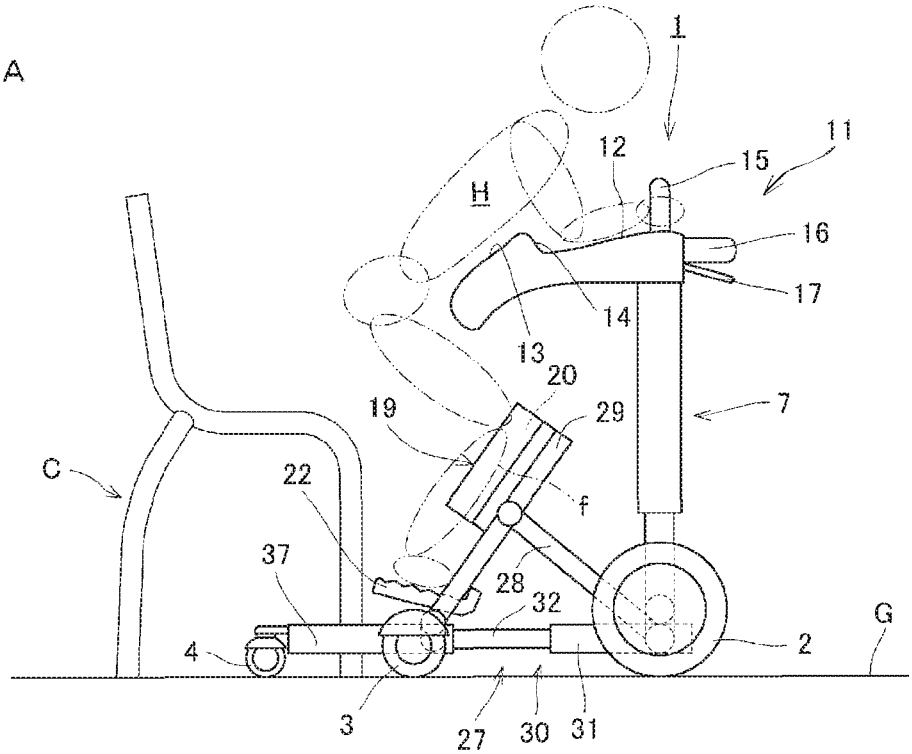
FIG. 4A is an explanatory view showing a mode immediately before and after the mode shown in FIG. 3B.

Next, as shown in FIG. 4A, the care receiver H brings his/her upper body into contact with the upper body guide portion 11 so as to lean on the upper body guide portion 11 with his/her upper body, and the care receiver H leans on the leg guide portion 19 with his/her lower leg front surfaces f so that the leg guide portion 19 is inclined frontward due to its own weight. With such frontward inclining of the leg guide portion 19, the front wheels 2 are going to move frontward using the rear wheels 3 each of which is substantially fixed by the brake as a fulcrum.

In this case, the care giver carefully operates the transfer device 1 such that the front wheels 2 slowly move frontward by gripping the handle portion 16 and, simultaneously, by releasing or applying braking to the front wheels 2 by the advancing and retracting restriction portion 17.

Figure 4B:
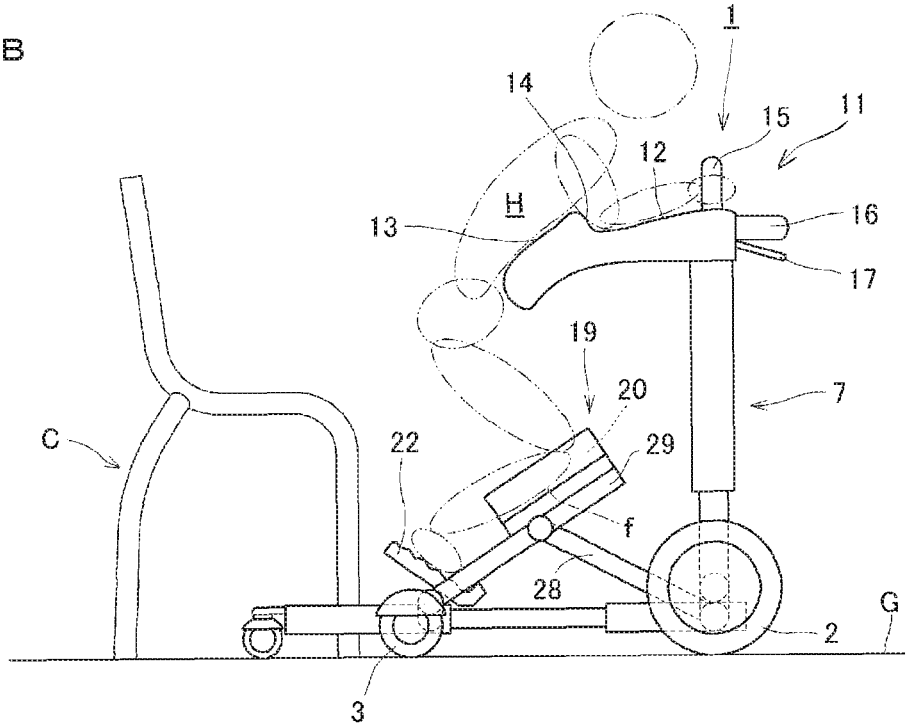
FIG. 4B is an explanatory view showing a mode immediately before and after the mode shown in FIG. 4A.

Then, as shown in FIG. 4B, when the care receiver H strongly brings his/her upper body into contact with the upper body guide portion 11 so as to lean on the upper body guide portion 11, his/her elbows engage with the elbow engaging portion 14 so that the upper body becomes stable. Accordingly, a strength of a lower half body of the care receiver H can be decreased and hence, the weight of the care receiver H with which the lower leg front surfaces f of the care receiver H incline the leg guide portion 19 frontward is increased so that the front wheels 2 are going to move further frontward. In this case, the care giver continuously operates the advancing and retracting restriction portion 17.

When the distance between the front and rear wheels 2, 3 becomes maximum, the care giver applies braking to the front wheels 2 by operating the advancing and retracting restriction portion 17. Next, the care giver manually releases braking applied to the rear wheels 3 and, then, grips the handle portion 16 and pulls the handle portion 16 frontward while keeping releasing of applying braking to the front wheels 2 by gripping both the handle portion 16 and the advancing and retracting restriction portion 17. Accordingly, the care giver can move the transfer device 1 on which the care receiver H rides in a stable state.

As shown in FIG. 5A, the transfer device 1 may be moved after sliding the upper body guide portion 11 frontward. In this case, the center of gravity of the transfer device 1 is further dispersed in the horizontal direction and hence, not only the transfer device 1 becomes more stable, but also a back side of the care receiver H is stretched so that the position of his/her buttocks slightly rises and hence, the care receiver H can take a more comfortable posture. Further, in such a state, the care giver can easily perform changing of underwear or the like of the care receiver H on the transfer device 1.

Figure 5B:
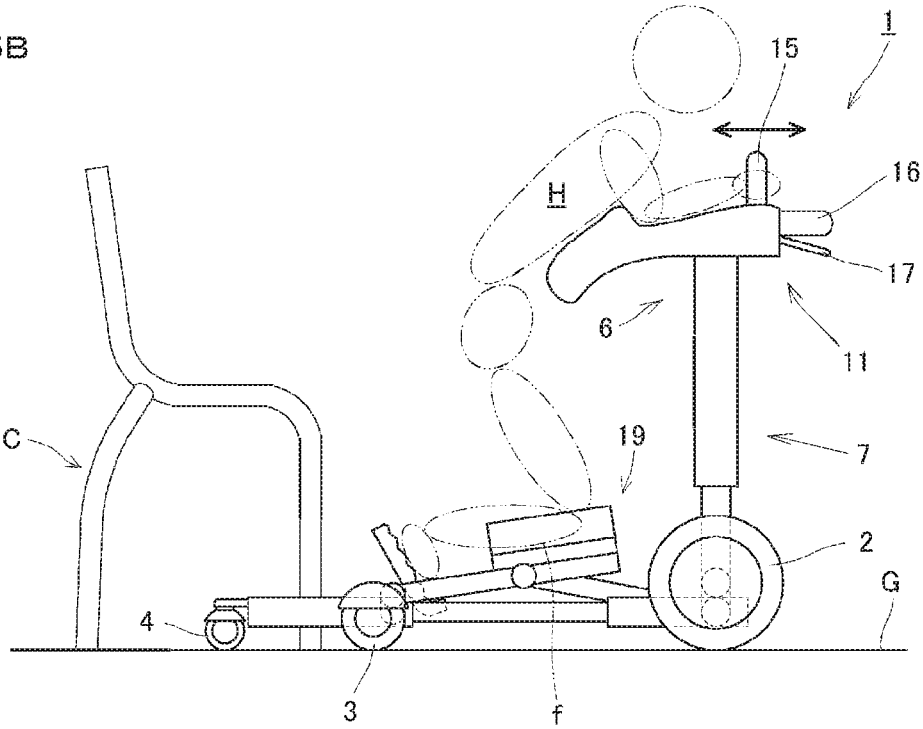
FIG. 5B is an explanatory view showing another example of the mode shown in FIG. 5A.

In FIG. 5A, the leg guide portion 19 is configured so as to prevent inclination exceeding a predetermined inclination angle toward a front side. However, as shown in FIG. 5B, the leg guide portion 19 may be configured to be inclined substantially horizontally.

The care giver can move the care receiver H to a desired place by moving the transfer device 1 in this manner.

For example, in a case where the desired place is the chair C which is placed in another place, to make the care receiver H sit on the chair C, as shown in FIG. 4B, the transfer device 1 on which the care receiver H rides is moved in front of the chair C. Then, braking is applied to the front wheels 2 by gripping the handle portion 16 and the advancing and retracting restriction portion 17. Then, the care giver manually applies braking to the rear wheels 3 by the brakes of the locking mechanism.

Next, in order to change the posture of the transfer device 1 from the posture shown in FIG. 4A to the posture shown in FIG. 3B, the care giver pushes the transfer device 1 in the direction toward the chair C such that the front wheels 2 slowly move rearward by releasing or applying braking from or to the front wheels 2 by gripping the handle portion 16 and, simultaneously, by operating the advancing and retracting restriction portion 17. With such an operation, the leg guide portion 19 can naturally move the entire body of the care receiver H in the direction toward the chair C while lifting the lower legs of the care receiver H.

In this case, the care giver can also operate the advancing and retracting restriction portion 17 while giving a care to the care receiver H while moving along side of the care giver H.

Then, when the care giver further pushes the transfer device 1 in the direction toward the chair C, the leg guide portion 19 is brought into an approximately vertical state. Accordingly, as shown in FIG. 3A, the care receiver H releases his/her hands from the grip portion 15, and can sit on the chair C.

In the case where the upper body guide portion 11 is slid frontward, by sliding the upper body guide portion 11 rearward immediately before the care receiver H sits on the chair C, it is possible to make the position of the buttocks of the care receiver H approach a seating surface at a final stage and hence, the care receiver H can maintain a comfortable posture until the care receiver H takes the final position.

As has been described above, the transfer device 1 according to this embodiment is capable of moving a care receiver H by a care giver. The transfer device 1 includes: the front wheels 2 and the rear wheels 3; the support body 6 which supports the upper body of the care receiver H; the leg guide portion 19 which is brought into contact with the lower leg front surfaces f of the care receiver H and is inclinable frontward from an approximately vertical state; and the foot placing portion 22 on which soles of the care receiver H are placed; the rear wheel advancing and retracting mechanism 27 which is configured to move the rear wheels 3 rearward in an interlocking manner with frontward inclining of the leg guide portion 19. With such a configuration, by merely transferring the care receiver H to the transfer device 1, a distance between the front and rear wheels 2, 3 is expanded and hence, stability of the transfer device 1 during the movement can be enhanced.

In transferring the care receiver H to the transfer device 1, by merely bringing lower leg front surfaces f of the care receiver H into contact with the leg guide portion 19 thus allowing the care receiver H to lean on the leg guide portion 19 with his/her own weight, the lower legs of the care receiver H are inclined frontwardly downward and hence, the care receiver H can maintain a comfortable posture during movement.

Further, in taking the care receiver H off the transfer device 1, it is possible to bring the lower legs of the care receiver H into an approximately upright state by merely pushing the transfer device 1 in the sitting direction and hence, the care receiver H can be seated in an extremely natural and comfortable posture.

It is unnecessary to frontwardly incline the upper body of the care receiver H more than necessary and hence, the care receiver H can maintain a more comfortable posture during the movement.

The support body 6 is formed of the support strut portions 7 which are erected upright and the upper body guide portion 11 which is disposed on the upper ends of the support strut portions 7, and the upper body guide portion 11 includes the grip portion 15 which the care receiver H grips and the handle portion 16 which the care giver grips for moving the transfer device 1. With such a configuration, in transferring the care receiver H to the transfer device 1 and during the movement of the transfer device 1, the care receiver H can prevent himself/herself from falling from the transfer device 1 by merely gripping the grip portion 15 thus ensuring safety. Further, the care giver can safely operate the transfer device 1 by merely gripping the handle portion 16.

The upper body guide portion 11 includes: the arm placing portion 12 which is formed approximately horizontally and on which the care receiver H places his/her elbows to front arms; the chest contact portion 13 which is brought into contact with a chest of the care receiver H, is inclined rearwardly downward, and is connected to a rear portion of the arm placing portion; and the elbow engaging portion 14 which is formed on the chest contact portion 13 as an integral part of the chest contact portion 13 at the rear portion of the arm placing portion 12 so as to make the upper end edge of the chest contact portion 13 protrude upward with respect to the rear end portion of the arm placing portion 12. With such a configuration, in transferring the care receiver H to the transfer device 1 and during the movement of the transfer device 1, the care receiver H can make his/her elbows engage with the elbow engaging portion 14 by merely placing his/her front arms on the arm placing portion 12 and hence, the care receiver H can stably lean on the transfer device 1 with his/her upper body.

The front arms of the care receiver H are placed on the substantially horizontal arm placing portion 12 and hence, the upper body of the care receiver H is not frontwardly inclined more than necessary and hence, the care receiver H can maintain a comfortable posture during the movement of the transfer device 1.

The upper body guide portion 11 is formed in an advancing and retracting manner longitudinally in the approximately horizontal direction. Accordingly, the center of gravity of the care receiver H with respect to the transfer device 1 is adjustable. Further, the posture of the care receiver H with respect to the transfer device is adjustable. Still further, in making the care receiver H sit on a predetermined place, by pushing the upper body guide portion 11 rearward in a final step, it is possible to make a seating object such as the chair C and buttocks of the care receiver H approach each other smoothly in a comfortable posture during the movement of the transfer device.

The transfer device includes the brakes which stop the rotation of at least the front wheels 2 and hence, safety of the transfer device can be enhanced.

The preferred embodiment of the transfer device 1 according to the embodiment of the present invention has been described heretofore. However, the present invention is not limited to the specific embodiment, and various modifications and alteration are conceivable.

What is claimed is:

1. A transfer device capable of moving a care receiver by a care giver, the transfer device comprising:

a front wheel and a rear wheel;

a support body configured to support an upper body of the care receiver;

a leg guide portion configured to be brought into contact with lower leg front surfaces of the care receiver and configured to be inclined frontward from an approximately vertical state;

and a foot placing portion on which soles of the care receiver are placed; and a rear wheel advancing and retracting mechanism configured to move the rear wheel rearward in an interlocking manner with frontward inclining of the leg guide portion.

2. The transfer device according to claim 1, wherein the support body is formed of a support strut portion erected upright and an upper body guide portion disposed on an upper end of the support strut portion, and the upper body guide portion includes a grip portion which the care receiver grips and a handle portion which the care giver grips for moving the transfer device.

3. The transfer device according to claim 2, wherein the upper body guide portion includes: an arm placing portion formed approximately horizontally, the arm placing portion on which the care receiver places his/her elbows to front arms; a chest contact portion configured to be brought into contact with a chest of the care receiver and being inclined rearwardly downward, the chest contact portion being connected to a rear portion of the arm placing portion; and an elbow engaging portion which is formed on the chest contact portion as an integral part of the chest contact portion at the rear portion of the arm placing portion so as to make an upper end edge of the chest contact portion protrude upward with respect to a rear end portion of the arm placing portion.

4. The transfer device according to claim 2, wherein the upper body guide portion is formed in an advancing and retracting manner longitudinally in an approximately horizontal direction.

5. The transfer device according to claim 1, further comprising a brake which stops rotation of at least the front wheel.

* * * * *